US008836451B2

(12) United States Patent
Yen et al.

(10) Patent No.: US 8,836,451 B2
(45) Date of Patent: Sep. 16, 2014

(54) WIDEBAND HIGH FREQUENCY BANDPASS FILTER

(75) Inventors: Ta-Jen Yen, Hsinchu County (TW); Ai-Ping Yen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 682 days.

(21) Appl. No.: 13/102,253

(22) Filed: May 6, 2011

(65) Prior Publication Data

US 2012/0139666 A1 Jun. 7, 2012

(30) Foreign Application Priority Data

Dec. 2, 2010 (TW) ..... 99141838 A

(51) Int. Cl.
*H01P 1/203* (2006.01)
*H01P 7/08* (2006.01)

(52) U.S. Cl.
CPC ..... *H01P 1/20363* (2013.01); *H01P 7/082* (2013.01); *H01P 1/20381* (2013.01)
USPC ..... 333/204; 333/219

(58) Field of Classification Search
CPC ..... H01P 1/20381; H01P 7/082
USPC ..... 333/136, 204, 205, 219, 235
See application file for complete search history.

(56) References Cited

U.S. PATENT DOCUMENTS

2007/0210881 A1* 9/2007 Shih ..... 333/204

OTHER PUBLICATIONS

Hu et al., "Novel Compact Ultra-Wideband Filter With Wide Stop-Band," Microwave and Optical Technology Letters, vol. 51, No. 1, Jan. 2009, pp. 53-55.

* cited by examiner

*Primary Examiner* — Benny Lee
*Assistant Examiner* — Gerald Stevens
(74) *Attorney, Agent, or Firm* — Muncy, Geissler, Olds & Lowe, P.C.

(57) ABSTRACT

A wideband high frequency bandpass filter uses a metamaterial transmission line composed of an open-circuit resonator and a short-circuit resonator to realize a bandpass filter at the band of 60 GHz. The bandpass filter has an ultra-wide passband resulting from the coupling of the two resonators in the resonant modes thereof. The ultra wide passband formed by resonance coupling includes a left-handed passband and a right-handed passband. The two passbands jointly provides a passband ranging from 57.4 GHz to 63.6 GHz and having a bandwidth of 6.2 GHz. The stopbands of the bandpass filter are respectively extended downward from 57.4 GHz to the DC current and extended upward from 63.6 GHz to 109.4 GHz. The bandpass filter of the present invention can be applied to wireless transmission at the band of 60 GHz.

4 Claims, 4 Drawing Sheets

WIDEBAND HIGH FREQUENCY BANDPASS FILTER

FIELD OF THE INVENTION

The present invention relates to a high frequency bandpass filter, and more particularly to a wireless high frequency bandpass filter.

BACKGROUND OF THE INVENTION

Bandpass filter is a necessary component for wireless communication products, and its main function is to separate frequencies. In other words, the bandpass filter can let a signal within a certain specific frequency band pass and block any signal other than those within the specific frequency band. As the wireless communication market booms, the requirement of communication quality becomes increasingly higher, and signal receivers require a wideband and high-efficiency bandpass filter to process the received high-frequency signal. The high-efficiency bandpass filter not only filters unnecessary interference signals, but also provides a wideband utility rate and good receiving efficiency to the high frequency signals.

As the bandwidth becomes wider and wider, data transfer rate increases significantly, so that researches and applications related to wireless transmission at a band near 60 GHz become more and more important in recent years. With a standard established by the Federal Communications Commission (FCC), any wireless communication at a band near 60 GHz (i.e. 57~64 GHz) enjoys the right of using free bandwidth about 7 GHz, and thus a wireless HD group formed by international major communication companies including LG, Panasonic, NEC, Samsung, Sony and Toshiba promotes that high resolution video without compression but with resolution up to 1920×1080 p can be wirelessly transmitted at the band of 60 GHz. In high frequency transmission, the band of 60 GHz can thoroughly implement wireless communication and high speed transmission in our daily life.

Various bandpass filters used in conventional commercial Wi-Fi and Bluetooth products are available in the market, and the most popular one among these products is the transmission-line bandpass filter, whose single-layer or double-layer metal structure can be integrated with other components directly on a printed circuit board. For example, Hong-Hong Hu et al. proposed "Novel Compact Ultra-Wideband Filter with Wide Stop-Band" in Microwave and Optical Technology Letters, Vol. 51, No. 1, pp. 53-55, January 2009, which discloses a transmission-line bandpass filter for general Wi-Fi band, and uses a signal transmission head incorporated with two T-shaped resonators to obtain a bandpass filtering effect. However, so far, the present 60 GHz filters still have the issues of high loss, a lower selectivity factor between a passband and a stopband, and limited extension of the stopband. Furthermore, group hysteresis of the transmission-line bandpass filter may cause signal waveform distortion. Besides, the conventional bandpass filter needs more elements and leads to higher design complexity and higher cost. Therefore, a simple-structure and low-cost bandpass filter is extremely desired to be developed.

SUMMARY OF THE INVENTION

The primary objective of the present invention is to solve the problems that the conventional types of bandpass filters for Wi-Fi or Bluetooth band cannot be directly used in the wireless transmission at a high frequency band of 60 GHz.

Another objective of the present invention is to provide a high frequency bandpass filter with wider passband and low loss.

To achieve the abovementioned objectives, the present invention proposes a wideband high frequency bandpass filter for filtering electromagnetic waves with central frequency at 60 GHz. This bandpass filter comprises a signal input terminal, a signal output terminal corresponding to the signal input terminal, an open-circuit resonator and a short-circuit resonator corresponding to the open-circuit resonator.

The signal input terminal receives an original electromagnetic wave. The signal output terminal outputs a filtered electromagnetic wave. The open-circuit resonator has a first strip line, a second strip line and a longitudinal open-circuit strip line. The first strip line is parallel to the second strip line. The longitudinal open-circuit strip line has two ends respectively connected with the first strip line and the second strip line, which are perpendicular to the longitudinal open-circuit strip line. The short-circuit resonator has a transverse short-circuit strip line and a longitudinal short-circuit strip line. The transverse short-circuit strip line is connected with the longitudinal short-circuit strip line. The longitudinal short-circuit strip line is perpendicular to the transverse short-circuit strip line and parallel to the longitudinal open-circuit strip line. The signal input terminal and the signal output terminal are arranged between the first strip line and the transverse short-circuit strip line.

The present invention features the design of the open-circuit resonator and the short-circuit resonator, wherein the right-handed stopband-passband conversion frequency is designed to be higher than the left-handed stopband-passband conversion frequency according to the metamaterial concept of the composite right/left-handed transmission lines. Thus is formed a wideband bandpass filter. Besides, by means of the first strip line, second strip line and longitudinal open-circuit strip line of the present invention, the energy loss can be effectively reduced. Thereby, the bandpass filter of the present invention can achieve wider passband and low loss at the band of 60 GHz.

DETAILED DESCRIPTION OF THE PREFERRED EMBODIMENTS

Figure 1:
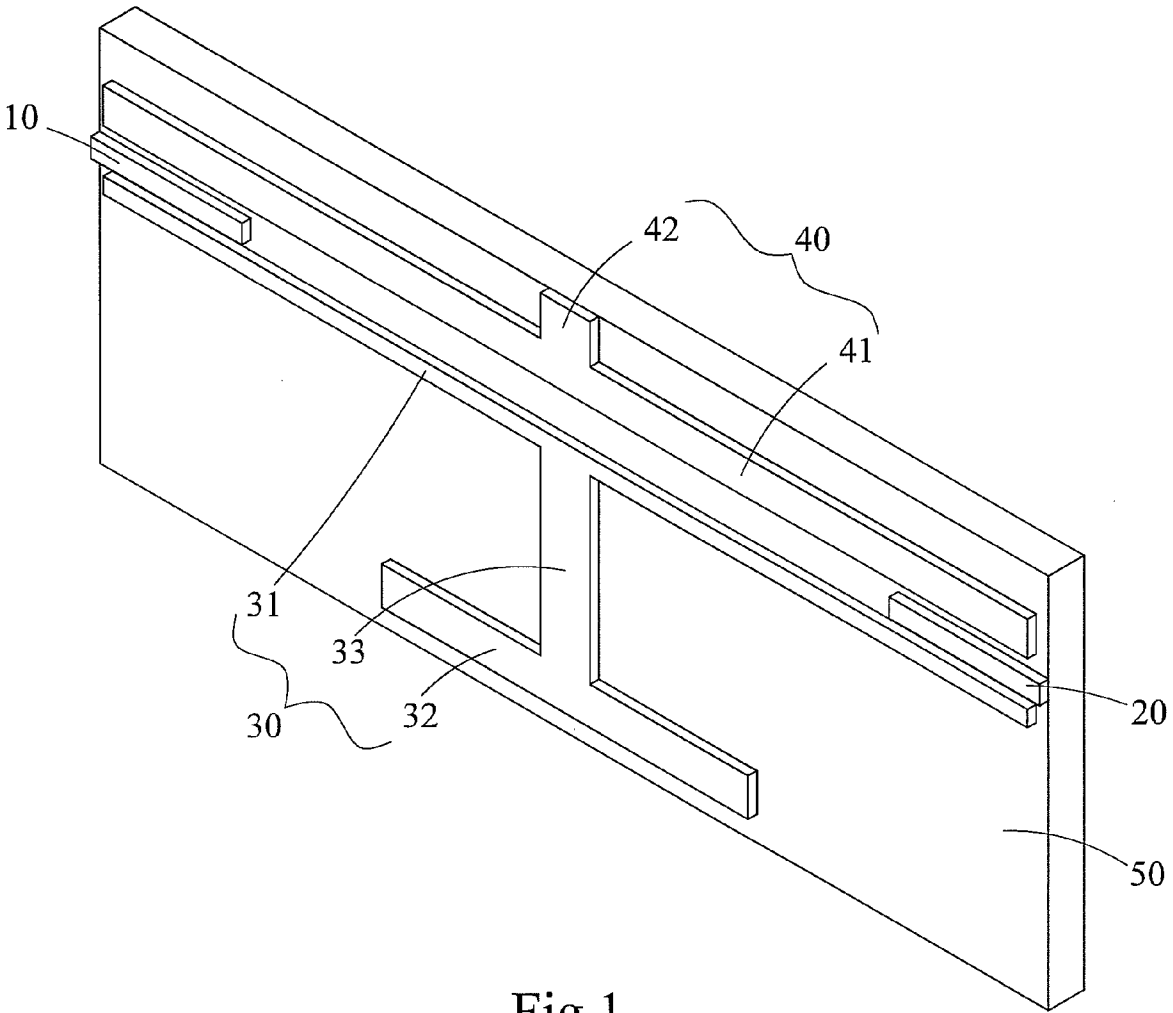
FIG. 1 is a perspective view schematically showing a wideband high frequency bandpass filter according to one embodiment of the present invention.
Figure 2:
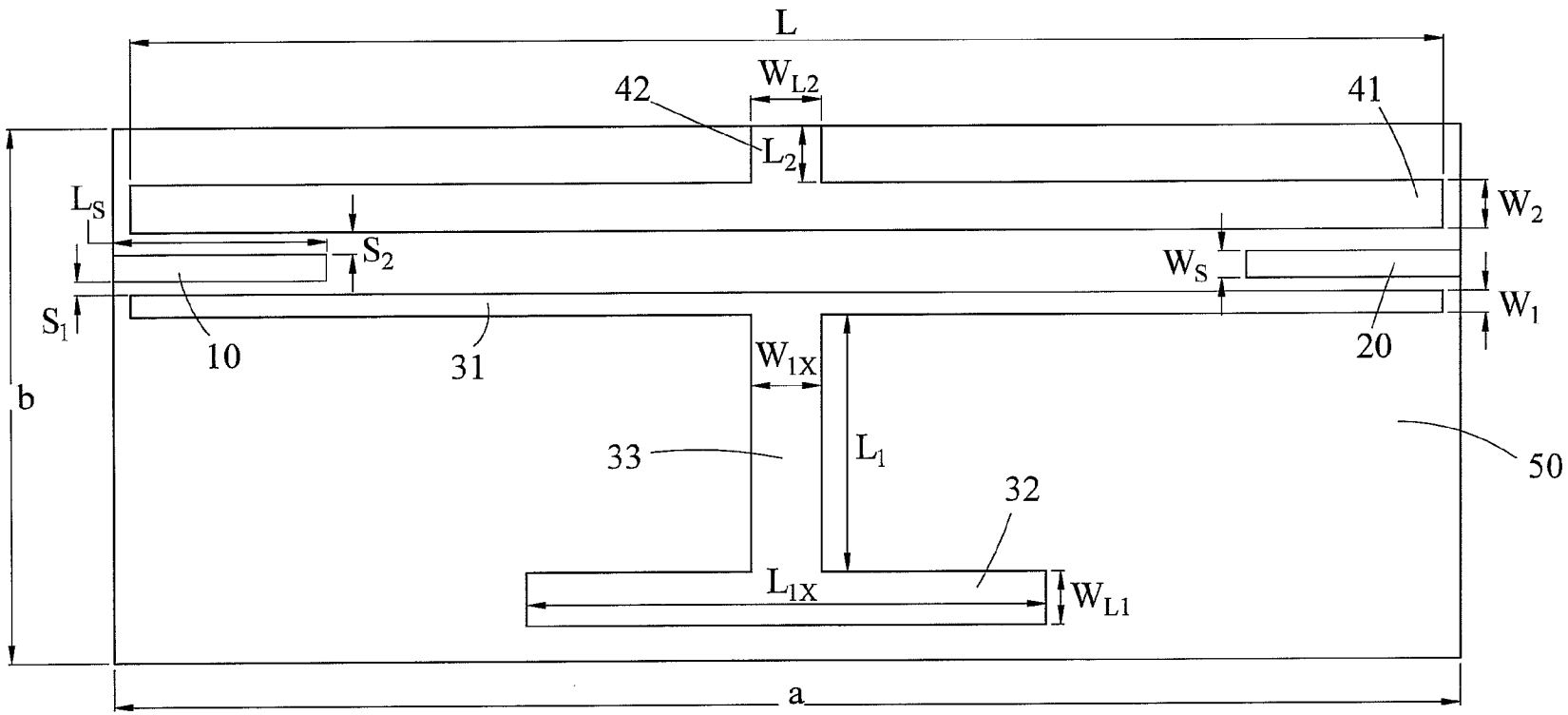
FIG. 2 is a schematic view showing the plane dimension of a wideband high frequency bandpass filter according to one embodiment of the present invention.

Refer to FIG. 1 and FIG. 2. The wideband high frequency bandpass filter of the present invention is used to filter an electromagnetic wave having a central frequency of 60 GHz and comprises a signal input terminal 10, a signal output terminal 20 corresponding to the signal input terminal 10, an open-circuit resonator 30 and a short-circuit resonator 40 corresponding to the open-circuit resonator 30.

The signal input terminal 10 receives an original electromagnetic wave. The signal output terminal 20 outputs a filtered electromagnetic wave. The open-circuit resonator 30 has a first strip line 31, a second strip line 32 and a longitudinal open-circuit strip line 33. The first strip line 31 is parallel to the second strip line 32. The longitudinal open-circuit strip line 33 has two ends respectively connected with the first strip line 31 and the second strip line 32, which are perpendicular to the longitudinal open-circuit strip line 33. The short-circuit resonator 40 has a transverse short-circuit strip line 41 and a longitudinal short-circuit strip line 42. The transverse short-circuit strip line 41 is connected with the longitudinal short-circuit strip line 42. The longitudinal short-circuit strip line 42 is perpendicular to the transverse short-circuit strip line 41 and parallel to the longitudinal open-circuit strip line 33. The signal input terminal 10 and the signal output terminal 20 are arranged between the first strip line 31 and the transverse short-circuit strip line 41.

It should be particularly explained that the first strip line 31 and the second strip line 32 are perpendicularly connected with the longitudinal open-circuit strip line 33 to effectively solve the conventional problem of high loss. The length of the first strip line 31 is greater than that of the second strip line 32. The first strip line 31 is symmetric to the second strip line 32 with the longitudinal open-circuit strip line 33 being the symmetric center. As shown in FIG. 1, the longitudinal open-circuit strip line 33 is parallel to the longitudinal short-circuit strip line 42. The transverse short-circuit strip line 41 also is parallel to the first strip line 31 and the second strip line 32. The first strip line 31 is spaced from the transverse short-circuit strip line 41 at a distance to accommodate the signal input terminal 10 and the signal output terminal 20. The signal input terminal 10 and the signal output terminal 20 are respectively arranged at two ends of the first strip line 31 or the transverse short-circuit strip line 41.

The abovementioned elements are arranged on a substrate 50, which is a ceramic substrate made of aluminum oxide. All the elements are laid on the substrate 50. Such a planar structure is adapted to common printed circuit boards and can be integrated with other communication elements to form an SOC (System On Chip). The first strip line 31, second strip line 32, longitudinal open-circuit strip line 33, transverse short-circuit strip line 41 and longitudinal short-circuit strip line 42 are respectively made of copper.

Refer to Table.1 for detailed specification and distance of a wideband high frequency bandpass filter according to one embodiment of the present invention. The substrate 50 has a thickness of 40 μm. The signal input terminal 10, signal output terminal 20, open-circuit resonator 30 and short-circuit resonator 40 on the substrate 50 have respectively a thickness of 10 μm.

TABLE 1 the specification of the high frequency bandpass filter

| Parameter | Value (mm) | Parameter | Value (mm) |
|---|---|---|---|
| a | 1.071 | b | 0.4221 |
| L | 1.043 | $W_s$ | 0.021 |
| $L_1$ | 0.203 | $L_2$ | 0.0441 |
| $W_{L1}$ | 0.042 | $W_{L2}$ | 0.056 |
| $W_1$ | 0.0175 | $W_2$ | 0.0385 |
| $S_1$ | 0.0105 | $S_2$ | 0.0175 |
| $L_{1x}$ | 0.413 | Ls | 0.175 |
| $W_{1x}$ | 0.042 | | |

Figure 3:
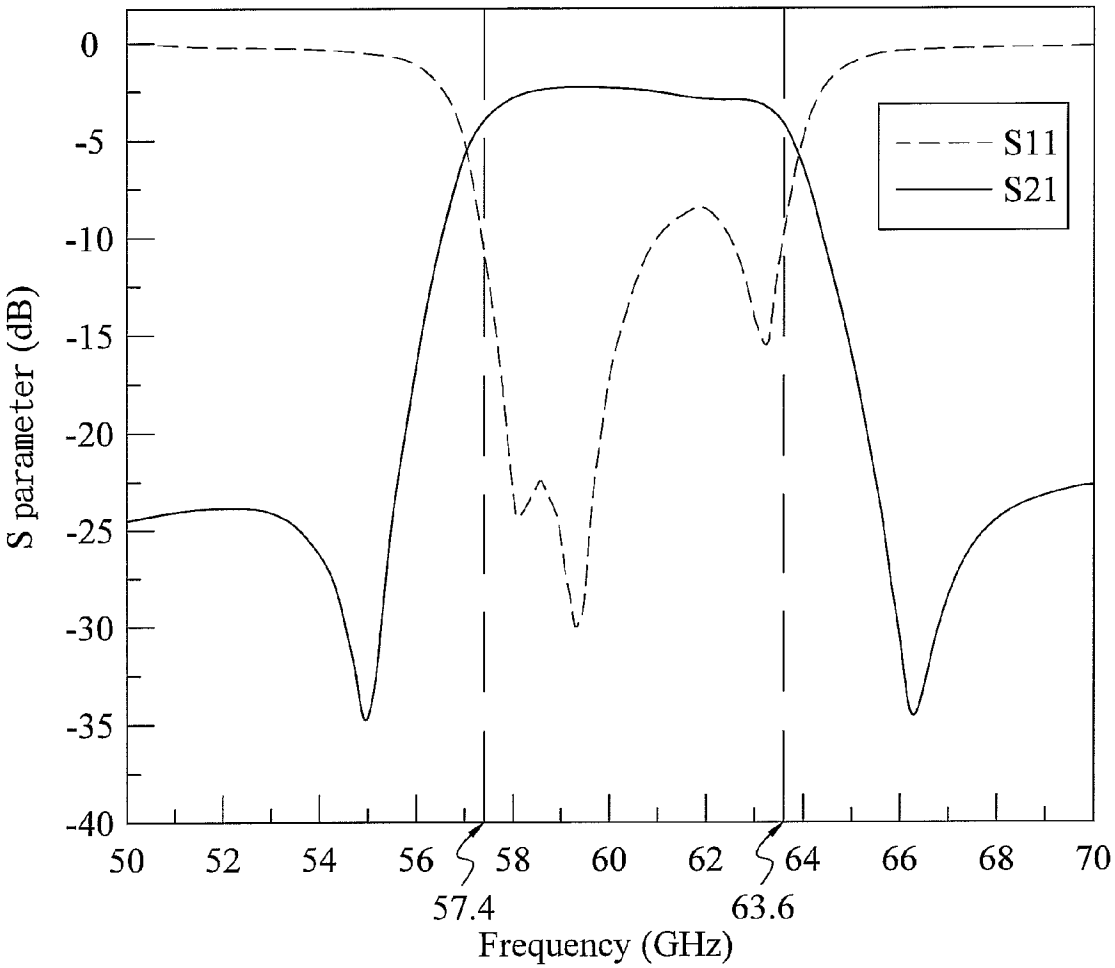
FIG. 3 shows the simulation result of a narrowband of S parameters according to one embodiment of the present invention.
Figure 4:
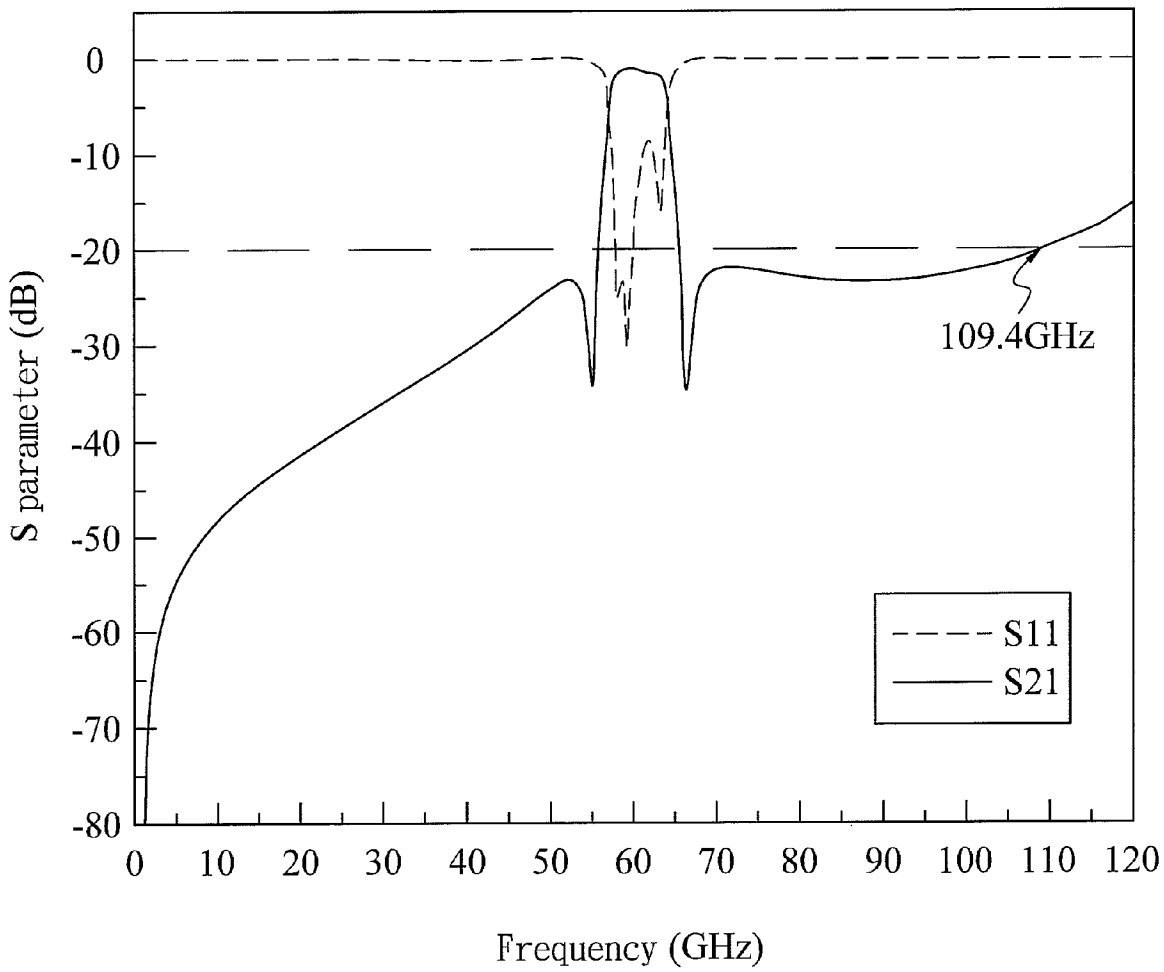
FIG. 4 shows the simulation result of a wideband of S parameters according to one embodiment of the present invention.

Refer to FIG. 3 for curve $S_{21}$, the frequencies of −3 dB respectively fall at 57.4 GHz and 63.6 GHz, which are close to 57 GHz and 64 GHz of the general band of 60 GHz. The passband thereof has a width reaching to 6.2 GHz, which is quite consistent with the utilized bandwidth of 7 GHz at the band of 60 GHz. The curve $S_{11}$ has lower values in the range of 57-64 GHz and thus has better impedance match. Refer to FIG. 4. FIG. 4 shows that the stopbands of the bandpass filter of the present invention are respectively extended downward from 57.4 GHz to the DC current and extended upward from 63.6 GHz to 109.4 GHz. Therefore, the bandpass filter of the present invention has very wide stopbands.

In conclusion, the present invention features the design of the open-circuit resonator 30 and the short-circuit resonator 40, wherein the right-handed stopband-passband conversion frequency is designed to be higher than the left-handed stopband-passband conversion frequency according to the metamaterial concept of the composite right/left-handed transmission lines. Thus is formed a wideband bandpass filter. Besides, by means of the first strip 31 line, second strip line 32 and longitudinal open-circuit strip line 33 of the present invention, the energy loss can be effectively reduced. Thereby, the bandpass filter of the present invention can achieve wider passband and low loss at the band of 60 GHz. From the simulation results, it is known that the passband-stopband conversion efficiency of the present invention exceeds 9 dB/GHz, and the stopbands of the present invention are respectively extended downward from 57.4 GHz to the DC current and extended upward from 63.6 GHz to 109.4 GHz. Therefore, the present invention can function as a high frequency bandpass filter for 60 GHz.

The above description has proved that the present invention possesses utility, novelty and non-obviousness and meets the condition for a patent. Thus, the inventor files the application for a patent. It is appreciated if the patent is approved fast.

The embodiments described above are only to exemplify the present invention but not to limit the scope of the present invention. Any equivalent modification or variation according to the spirit of the present invention is to be also included within the scope of the present invention.

What is claimed is:

1. A wideband high frequency bandpass filter, which is used to filter an electromagnetic wave having a central frequency of 60 GHz, comprising:

a signal input terminal receiving an original electromagnetic wave;

a signal output terminal arranged correspondingly to the signal input terminal and outputting the filtered electromagnetic wave;

an open-circuit resonator including a first strip line, a second strip line and a longitudinal open-circuit strip line; the first strip line being parallel to the second strip line; the longitudinal open-circuit strip line having two ends respectively connected with the first strip line and the second strip line, and the first strip line and the second strip line being perpendicular to the longitudinal open-circuit strip line, wherein the first strip symmetric to the second strip line with the longitudinal open-circuit strip line being the symmetric center; and a short-circuit resonator arranged correspondingly to the open-circuit resonator and including a transverse short-circuit strip line adjacent to the first strip line and a longitudinal short-circuit strip line; the transverse short-circuit strip line being connected with the longitudinal short-circuit strip line, and the longitudinal short-circuit strip line being perpendicular to the transverse short-circuit strip line and being parallel to the longitudinal open-circuit strip line; the signal input terminal and the signal output terminal being arranged between the first strip line and the transverse short-circuit strip line and respectively at two ends of the first strip line or the transverse short-circuit strip line; wherein the signal input terminal and the signal output terminal have respectively a length of 0.175 mm and a width of 0.021 mm, and the signal input terminal and the signal output terminal being respectively spaced from the transverse short-circuit strip line at a distance of 0.0175 mm and respectively spaced from the first strip line at a distance of 0.0105 mm, the transverse short-circuit strip line has a length of 1.043 mm and a width of 0.0385 mm, the longitudinal short-circuit strip line has a length of 0.0441 mm and a width of 0.056 mm, the first strip line has a length of 1.043 mm and a width of 0.0175 mm, the second strip line has a length of 0.413 mm and a width of 0.042 mm, the longitudinal open-circuit strip line has a length of 0.203 mm and a width of 0.042 mm.

2. The wideband high frequency bandpass filter according to claim 1 further comprising a substrate to hold the signal input terminal, the signal output terminal, the open-circuit resonator and the short-circuit resonator; the first strip line, the second strip line, the longitudinal open-circuit strip line, the transverse short-circuit strip line and the longitudinal short-circuit strip line being laid on the substrate.

3. The wideband high frequency bandpass filter according to claim 1 further comprising a substrate to hold the signal input terminal, the signal output terminal, the open-circuit resonator and the short-circuit resonator; the first strip line, the second strip line, the longitudinal open-circuit strip line, the transverse short-circuit strip line and the longitudinal short-circuit strip line being laid on the substrate; the substrate having a length of 1.071 mm, a width of 0.4221 mm and a thickness of 40 μm; the signal input terminal, the signal output terminal, the open-circuit resonator and the short-circuit resonator being held on the substrate; the first strip line, the second strip line, the longitudinal open-circuit strip line, the transverse short-circuit strip line and the longitudinal short-circuit strip line have respectively a thickness of 10 μm.

4. The wideband high frequency bandpass filter according to claim 3, wherein the first strip line, the second strip line, the longitudinal open-circuit strip line, the transverse short-circuit strip line and the longitudinal short-circuit strip line are respectively made of copper, and the substrate is made of aluminum oxide.

* * * * *